United States Patent [19]

Costin et al.

[11] Patent Number: 4,986,940

[45] Date of Patent: Jan. 22, 1991

[54] CURING PROCESS FOR THE MANUFACTURE OF THERMOPLASTIC ELASTOMER BINDERS

[75] Inventors: C. Richard Costin, West Chester; Michael A. Bailey, Boothwyn, both of Pa.

[73] Assignee: Sartomer Company, Inc., Exton, Pa.

[21] Appl. No.: 432,085

[22] Filed: Nov. 6, 1989

[51] Int. Cl.[5] ..... C06B 45/10; C06B 21/00

[52] U.S. Cl. ..... 264/3.1; 149/19.91; 149/19.92

[58] Field of Search ..... 149/19.92, 19.91; 264/3.1

[56] References Cited

U.S. PATENT DOCUMENTS

| | | | |
|---|---|---|---|
| 3,145,528 | 8/1964 | D'Alelio | 179/19.92 |
| 3,158,991 | 12/1964 | D'Alelio | 149/19.92 |
| 3,203,169 | 8/1965 | D'Alelio | 149/19.92 |
| 3,203,170 | 8/1965 | D'Alelio | 149/19.92 |
| 3,214,306 | 10/1965 | Colichman et al. | 149/19.92 |
| 3,462,952 | 8/1969 | D'Alelio | 149/19.92 |
| 3,786,116 | 1/1974 | Milkovich et al. | 260/885 |
| 3,928,255 | 12/1975 | Milkovich et al. | 260/2.5 |
| 4,056,416 | 11/1977 | Franklin et al. | 149/19.92 |
| 4,343,664 | 8/1982 | Iyer | 149/19.92 |
| 4,521,260 | 6/1985 | Johnson et al. | 149/19.92 |

*Primary Examiner*—Edward A. Miller

*Attorney, Agent, or Firm*—Young, Lewis J.

[57] ABSTRACT

Thermoplastic elastomers made by copolymerizing macromolecular monomers with alkoxyalkyl acrylates in the presence of energetic materials serve as solid propellants which have high burn rates and increased insensitivity over conventional propellants. The copolymers are prepared in situ by subjecting the mixture of monomers and energetic materials to electron beam radiation.

3 Claims, No Drawings

CURING PROCESS FOR THE MANUFACTURE OF THERMOPLASTIC ELASTOMER BINDERS

BACKGROUND OF THE INVENTION

The present invention is directed to a novel curing process for the manufacture of thermoplastic elastomer binders. The thermoplastic elastomers comprise copolymers of macromolecular monomers and alkyl acrylates. In conjunction with energetic materials, the binders form solid propellants with high burn rates and increased insensitivity over conventional binders.

It is known that thermoplastic elastomers can be used as binders for the energetic materials in solid propellants. It is also known that thermoplastic elastomers based on block copolymers of styrene and butadiene or isoprene exhibit greater shock insensitivity than the crosslinked binders that are currently used in solid propellants.

The macromolecular monomers of this invention are primarily those taught by Milkovich et al, U.S. Pat. No. 3,786,116, which is hereby incorporated in its entirety into this application. Copolymer compositions comprising the macromolecular monomers and alkyl acrylates are also taught in this patent.

U.S. Pat. No. 3,928,255, also incorporated herein by reference, teaches hydrophilic copolymers made from macromolecular monomers and either hydroxyalkyl acrylates or hydroxyalkoxyalkyl acrylates.

BRIEF SUMMARY OF THE INVENTION

We have now found that solid propellants can be produced by curing mixtures of certain macromolecular monomers and alkyl acrylate monomers, and the energetic materials by electron beam radiation during the manufacturing process. The resultant materials exhibit increased shock insensitivity and increased thermal insensitivity, high burn rate and excellent wetting of the energetic material.

DETAILED DESCRIPTION OF THE INVENTION

The thermoplastic elastomers of the invention are made by copolymerizing macromolecular monomers with monofunctional, difunctional, and multifunctional acrylate and urethane acrylate monomers, with or without solvent, under a nitrogen purge. The range of copolymer molecular weight formed is from 150,000 to 1,000,000. The composition of the copolymer ranges from 5 to 50 percent macromolecular monomer. The range of the molecular weight of the macromolecular monomer used is from 5,000 to 50,000. The thermoplastic elastomer binder solution contains no volatiles and does not require initiator or catalyst for curing. The radiation dose level for curing can be between 3 and 12 mrads dependent upon the desired cure rate and process time.

The macromolecular monomers are prepared by anionic polymerization of one or more vinyl aromatic compounds in the presence of a lithium-based initiator such as lithium metal, alkyl lithium compounds, aryl lithium compounds or mixtures thereof. The preferred initiators are alkyl lithium compounds such as the lower alkyl lithium compounds. The preferred initiator is sec-butyl lithium. Typical of the vinyl aromatic compounds useful in the macromolecular monomers are styrene, alpha-methylstyrene, nuclear-methylstyrene, indene, and p-tert-butylstyrene. Mixtures of two or more of these may be used if desired. The polymeric anion is then terminated with a compound which provides an addition polymerizable end group, such as acryloyl or methacryloyl chloride The molecular weight distribution of the macromolecular monomers may range up to 3 or more, preferably up to about 2.

Since in some cases the polymeric anion resulting from the anionic polymerization is highly reactive and non-selective in reaction with a terminating agent which incorporates an addition polymerizable group into the macromolecular monomer, resulting in polymer chains having undesired functionality and molecular weight, the "living polymer" can be made less reactive by capping the polymeric anion with a less reactive end group prior to termination. Suitable capping agents include lower alkylene oxides or sulfides, such as ethylene and propylene oxide or sulfide.

The process of this invention does not require the use of a solvent for the polymerization. If used, the solvents used for polymerization may be any of the known solvents, especially ethyl acetate, cyclohexane, toluene, or a mixture of these solvents. The copolymerization is run on mixtures containing approximately 18% of the binder solution based on the filled material. The time of polymerization is adjusted so that the acrylate monomer is greater than 95% converted to copolymer.

The energetic materials useful in the invention may be solid oxidizers, solid fuels, cyclic nitramines, and various other additives and fillers.

The solid oxidizers useful in the propellants are employed in powdered form and include the nitrates, perchlorates, chlorates, permanganates, chromates, and dichromates of the alkali or alkaline earth metals, ammonia, hydrazine, or guanidine. Examples of the solid oxidizers are ammonium nitrate, ammonium perchlorate, sodium nitrate, potassium perchlorate, lithium chlorate, calcium nitrate, barium perchlorate, strontium chlorate, and the like, with ammonium perchlorate being preferred.

The propellant also preferably includes a solid fuel componemt in powdered form. Examples of these are metals such as aluminum, boron, magnesium, and beryllium; metal alloys such as the aluminum alloys of boron, magnesium, manganese, zinc, and copper; metal hydrides such as the hydrides of aluminum and beryllium. These solid fuels are used in concentrations consistent with good mixing characteristics (usually between about 2 and 30 weight percent of the propellant composition).

Also useful are the cyclic nitramines such as cyclotrimethylene, trinitramine and cyclotetramethylenetetranitramine.

The propellant composition may also include other conventional propellant ingredients such as antioxidants, wetting agents, metal oxides, reinforcing agents, burning rate catalysts, resonance suppressors, and the like. These additives usually comprise 10% or less of the propellant composition.

The following examples are meant to further illustrate but not to limit the invention.

EXAMPLE I

A blend of 200 g of macromolecular monomer (a 13,000 molecular weight polystyrene having an acrylate end group) with 200 g of n-butyl acrylate was made in a one pint aluminum jar. Into a 250 ml plastic beaker, was placed 18 g of the above blend. A mixture of 29.5 g of 20 micron diameter aluminum powder and 52.5 g of a 90/10 unground/ground potassium chloride was prepared in a separate container and then added to the 250 ml plastic beaker with mixing. The above binder/filler material was poured into an aluminum tray lined with a sheet of Mylar. A second sheet of Mylar was placed over the binder/filler material and then the sample thickness was made uniform. The binder/filler material was then cured by passing through an electron beam with parameters set to give a radiation dose level of 3 mrads. The sample was repeatedly passed through the beam until the material was completely cured. The cured binder/filler material exhibited a hard, dull surface, strong tensile strength, brittle failure and poor elongation.

EXAMPLE II

The process of Example I was repeated except that the n-butyl acrylate was replaced by methoxyethyl acrylate.

The cured binder/filler material exhibited a brick hard, dull surface, strong tensile strength, brittle failure and poor elongation.

EXAMPLE III

A blend of 60 g of macromolecular monomer (a 13,000 molecular weight polystyrene having an acrylate end group) with 340 g of n-butyl acrylate was made in a one pint aluminum jar. Into a 250 ml plastic beaker, was placed 10 g of a preformed copolymer of 15% of the above mentioned macromolecular monomer and 85% of n-butyl acrylate and 90 g of n-butyl acrylate. To this was added 100 g of the blend from the aluminum jar. The resulting blend (18 g) was added to a second 250 ml beaker. A mixture of 29.5 g of 20 micron diameter aluminum powder and 52.5 g of a 90/10 unground/ground potassium chloride was prepared in a separate container and then added to the 250 ml plastic beaker with mixing. The above binder/filler material was poured into an aluminum tray lined with a sheet of Mylar. A second sheet of Mylar was placed over the binder/filler material and then the sample thickness was made uniform. The binder/filler material was then cured by passing through an electron beam with parameters set to give a radiation dose level of 3 mrads. The sample was repeatedly passed through the beam until the material was completely cured. The cured binder/filler material exhibited a dull, slightly hard surface, good tensile strength, but only slight elongation.

EXAMPLE IV

A blend of 60 g of macromolecular monomer (a 13,000 molecular weight polystyrene having an acrylate end group) with 340 g of methoxyethyl acrylate was made in a one pint aluminum jar. Into a 250 ml plastic beaker, was placed 10 g of a preformed copolymer of 15 % of the above mentioned macromolecular monomer and 85% of methoxyethyl acrylate and 90 g of methoxyethyl acrylate. To this was added 100 g of the blend from the aluminum jar. The resulting blend (18 g) was added to a second 250 ml beaker. A mixture of 29.5 g of 20 micron diameter aluminum powder and 52.5 g of a 90/10 unground/ground potassium chloride was prepared in a separate container and then added to the 250 ml plastic beaker with mixing. The above binder/filler material was poured into an aluminum tray lined with a sheet of Mylar. A second sheet of Mylar was placed over the binder/filler material and then the sample thickness was made uniform. The binder/filler material was then cured by passing through an electron beam with parameters set to give a radiation dose level of 3 mrads. The sample was repeatedly passed through the beam until the material was completely cured. The cured binder/filler material exhibited a semi-hard surface, good tensile strength, slightly brittle failure and only slight elongation.

EXAMPLE V

The procedure of Example III was repeated except the 60 g of macromolecular monomer was dissolved in a solution of 300 g of n-butyl acrylate and 40 g of n-vinyl pyrolidone. The cured binder/filler material exhibited a tacky surface and good tensile strength and elongation.

EXAMPLE VI

The procedure of Example III was repeated except the 60 g of macromolecular monomer was dissolved in a solution of 320 g of n-butyl acrylate and 20 g of $C_{14}$–$C_{15}$ diol diacrylate. The cured binder/filler material exhibited a slightly hard surface, good tensile strength and some elongation.

EXAMPLE VII

A blend of 60 g of macromolecular monomer (a 25,000 molecular weight polystyrene having an acrylate end group) with 340 g of n-butyl acrylate was made in a one pint aluminum jar. Into a 250 ml plastic beaker, was placed 10 g of a preformed copolymer of 15 % of the above mentioned macromolecular monomer and 85% of n-butyl acrylate and 90 g of n-butyl acrylate. To this was added 100 g of the blend from the aluminum jar. The resulting blend (18 g) was added to a second 250 ml beaker. A mixture of 29.5 g of 20 micron diameter aluminum powder and 52.5 g of a 90/10 unground/ground potassium chloride was prepared in a separate container and then added to the 250 ml plastic beaker with mixing. The above binder/filler material was poured into an aluminum tray lined with a sheet of Mylar. A second sheet of Mylar was placed over the binder/filler material and then the sample thickness was made uniform. The binder/filler material was then cured by passing through an electron beam with parameters set to give a radiation dose level of 3 mrads. The sample was repeatedly passed through the beam until the material was completely cured. The cured binder/filler material exhibited a very tacky surface, average tensile strength, and good elongation.

We claim:

1. A method of making solid propellants from thermoplastic elastomer binders and energetic materials consisting essentially of (a) forming a blend of macromolecular monomers, prepared by anionic polymerization of one or more vinyl aromatic compounds and terminated with an acrylate or methacrylate group, and monomers selected from alkyl acrylates, alkoxyalkyl acrylates, diacrylate monomers, and mixtures thereof;

(b) mixing into the above blend suitable energetic materials selected from solid oxidizers, solid fuels, a cyclic nitramines, and mixtures of these;

(c) forming the mixture of (a) and (b) into a suitable shape; and (d) subjecting the shaped mixture of (c) to an electron beam with a dose level of between 3 and 12 mrads until the composition is completely cured.

2. The process of claim 1 wherein said solid oxidizer is selected from the group consisting of the nitrates, perchlorates, chlorates, permanganates, chromates, and dichromates of the alkali or alkaline earth metals, ammonia, hydrazine, or guanidine.

3. The process of claim 1 wherein said solid fuel component is selected from the group consisting of metals, metal alloys, and metal hydrides.

* * * * *

UNITED STATES PATENT AND TRADEMARK OFFICE

CERTIFICATE OF CORRECTION

PATENT NO. : 4,986,940

DATED : January 22, 1991

INVENTOR(S) : C. Richard Costin and Michael A. Bailey

It is certified that error appears in the above-identified patent and that said Letters Patent is hereby corrected as shown below:

Column 4, line 62 "a" should be deleted.

Signed and Sealed this

Fourteenth Day of July, 1992

*Attest:*

DOUGLAS B. COMER

*Attesting Officer*

*Acting Commissioner of Patents and Trademarks*